United States Patent [19]

Pfefferkorn et al.

[11] Patent Number: 4,856,668

[45] Date of Patent: Aug. 15, 1989

[54] BOTTLE CLOSURE FOR CHAMPAGNE BOTTLE AND THE LIKE HAVING THREADED MOUTHS

[75] Inventors: Bernd Pfefferkorn; Hans Pfefferkorn; Viktor Reiter, all of Simmern, Fed. Rep. of Germany

[73] Assignee: Pfefferkorn & Co. GmbH, Simmern, Fed. Rep. of Germany

[21] Appl. No.: 311,428

[22] Filed: Feb. 14, 1989

Related U.S. Application Data

[63] Continuation of Ser. No. 145,886, Jan. 20, 1988, abandoned.

[30] Foreign Application Priority Data

Sep. 24, 1987 [DE] Fed. Rep. of Germany ..... 3732112

[51] Int. Cl.[4] ..... B65D 41/04

[52] U.S. Cl. ..... 215/329; 215/354

[58] Field of Search ..... 215/329, 354, 344, DIG. 1, 215/365, 366

[56] References Cited

U.S. PATENT DOCUMENTS

| | | | |
|---|---|---|---|
| 2,582,721 | 1/1952 | Roshkind | 215/354 X |
| 2,717,728 | 9/1955 | Gray | 215/354 X |
| 3,074,579 | 1/1963 | Miller | 215/354 X |
| 4,090,631 | 5/1978 | Grussen | 215/329 |
| 4,450,973 | 5/1984 | Toeppen | 215/329 |
| 4,645,088 | 2/1987 | Menichetti | 215/329 |

FOREIGN PATENT DOCUMENTS

| | | |
|---|---|---|
| 2204979 | 8/1973 | Fed. Rep. of Germany . |
| 2833099 | 2/1980 | Fed. Rep. of Germany . |
| 3202924 | 8/1983 | Fed. Rep. of Germany . |

*Primary Examiner*—Donald F. Norton

*Attorney, Agent, or Firm*—Koda and Androlia

[57] ABSTRACT

The invention relates to a bottle closure which is suitable, in particular, for champagne bottles having threaded mouths. This bottle closure is unitary made and is of plastic and has a stopper like sealing shank, with a smooth exterior, which penetrates into the neck of the bottle. A cap comprising an internal thread which is adapted to the external thread of the bottle is provided around the sealing shank. The latter projects somewhat beyond the thread of the cap so that, when the bottle closure is opened, a "plop" which is a typical noise of a champagne bottle, is produced. The bottle itself has a bead which, when the bottle closure is in place, is covered by the lower end of the cap. Between the uppermost turn of the thread of the cap and the beginning of the sealing shank on the cap there is provided a sealing lip which, when the bottle closure is in place, bears upon the upper edge of the neck of the bottle.

7 Claims, 3 Drawing Sheets

BOTTLE CLOSURE FOR CHAMPAGNE BOTTLE AND THE LIKE HAVING THREADED MOUTHS

This is a continuation of application Ser. No. 145,886, filed Jan. 20, 1988 now abandoned.

BACKGROUND OF INVENTION (a) Field of the Invention

This invention relates to a bottle closure, which is useful more particularly for champagne bottles having threaded mouths, and wherein the body of the closure is unitary and is made of plastic and comprises a stopper like sealing shank which penetrates into the neck of the bottle. In this type of bottle closure, the shank runs centrally from the inner surface of the end of the cap, and the internal surface of the wall of the cap comprises a thread with which the external thread of the neck of the bottle can be engaged. The sealing shank projects beyond the area which carries the thread, a bead surrounding the neck of the bottle is provided at the upper end of the neck, and the external thread of the neck is provided between the bead and the upper edge of the neck of the bottle.

(b) Description of Prior Art

Bottle closures provided with screw threads are used for a very wide variety of applications (cf. U.S. Pat. No. 3,074,579; French Published Specification No. 2,306,895 dated November 1976; French Pat. No. 1,030,600 dated June 1953). However, most of these bottle closures are not suitable for champagne bottles.

Bottle closures of this kind are used mainly for small champagne bottles holding 0.2 liters.

One of the disadvantages of known bottle closures (cf. German Printed Publication No. 26 14 538, French Printed Publication No. 2 306 896 dated October 1977) is that they fail to produce the typical "plop", so characteristic of champagne, when the bottle is opened.

In the meanwhile, a bottle closure of the type in question which produces a "plop" when the champagne bottle is opened has become known (EP-B 0 079 552), this bottle closure comprises a sealing rib at the level of the last turn of a multi-start thread or beyond same on the projecting part. The disadvantage of this bottle closure is that, in spite of the relatively costly sealing shank, the "plop" does not always occur. The reason for this is that, when the sealing rib reaches the upper edge of the neck of the bottle, the rib may tilt, so that $CO_2$ escapes on one side while the rib still maintains a good seal on the other side.

In one known screw closure for a container, it is known to provide a curving sealing shank which does not have a plurality of sealing ribs (German Printed Publication No. 30 08 838 dated October 1980). This closure also has a sealing lip which, in the closed condition, bears upon the upper edge of the container. The disadvantage of this closure is that it cannot produce a "plop" because the sealing shank does not project beyond the last turn of the screw closure.

A similar screw closure, in which the sealing shank is not curved, is also known (German Printed Publication No. 32 18 671 dated November 1983). However, this closure cannot be used for champagne bottles because it does not have a dome shaped cap.

SUMMARY OF INVENTION

It is the purpose of the invention to provide a bottle closure comprising a sealing shank of simple design which can still produce a "plop" when a champagne bottle is opened.

This purpose is accomplished by providing a bottle closure wherein the sealing shank has a smooth outer surface, a sealing lip is provided between the upper end of the sealing shank and the first turn of the internal thread, the sealing lip bearing upon the upper edge of the bottle when the bottle closure is in place, the lower edge of the cap covering the bead when the bottle closure is in place.

The particular advantage achieved by means of the invention is that a "plop" is produced by the combination of an upper sealing lip and an externally smooth sealing shank, resulting in a very effective seal. A separate sealing rib is not required since the fact that the lower edge of the sealing shank is located below the last turn of the thread is enough to produce the "plop". In addition, most bottles carry a bead on the inside of the upper edge and the best seal is always at this bead. Another advantage of the invention is that the closure fits conventional bottle threads and no special bottles are required. Furthermore, the closure can be fitted very tightly since the lower part of the cap covers the outer bottle neck bead and is not seated upon it. This bead therefore does not act as a stop to prevent further rotation of the closure.

BRIEF DESCRIPTION OF DRAWINGS

An example of execution of the invention is illustrated in the drawings and will be described more in detail hereinbelow.

In the drawings.

DESCRIPTION OF PREFERRED EMBODIMENTS

Figure 1:
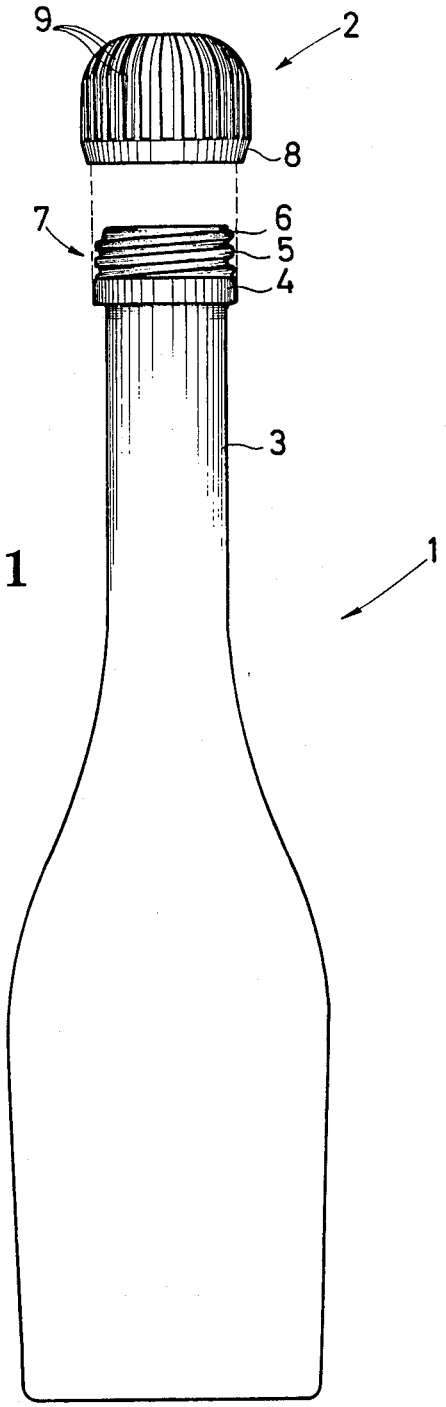
FIG. 1 shows a 0.2 liter champagne bottle with a plastic bottle closure in the unclosed condition.

FIG. 1 shows a 0.2 liter champagne bottle 1 with a bottle closure 2 according to the invention. This bottle comprises, at the end of neck 3, a bead 4, above which two turns 5,6 of a screw thread 7 are visible.

The bottle closure 2 is essentially in the form of a dome and has an inwardly directed chamfer 8 at its lower edge. The surface of the closure is provided with ribs 9 to prevent the fingers from slipping when the closure is being screwed or removed.

Figure 2:
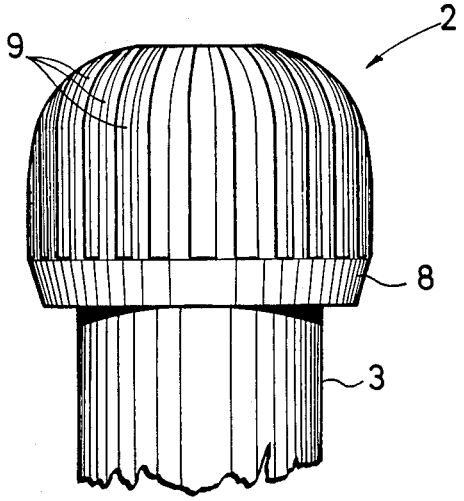
FIG. 2 shows a bottle neck with a bottle closure screwed thereto.

The bottle closure is shown again in FIG. 2, on a somewhat enlarged scale, and screwed to neck 3 of the bottle. It will be noted that the part of the closure comprising chamfer 8 covers bead 4 of the neck 3 of the bottle.

Figure 3:
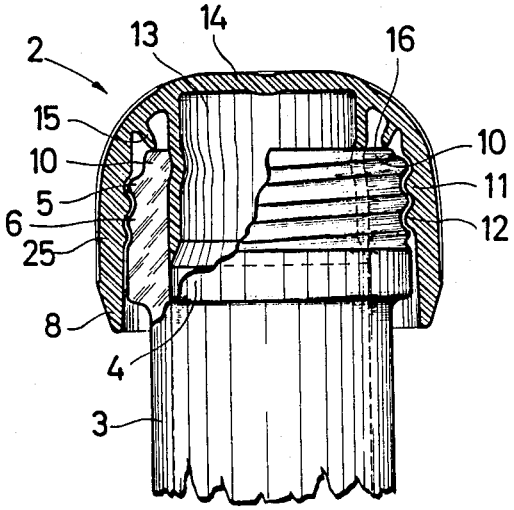
FIG. 3 is a view similar to FIG. 2, except that the bottle closure is in cross-section.

FIG. 3 largely resembles FIG. 2, except that bottle closure 2 is shown in cross-section. A dotted line shows the wall thickness of the neck of the bottle.

As may be seen in this figure, the upper edge of neck 3 of the bottle shows an inwardly directed curve 10. The inside of the bottle closure carries thread turns 11,12 engaging in the spaces between turns 5,6 of neck 3 of the bottle. A stopper like sealing shank 13 penetrates into neck 3 of the bottle and downwardly and vertically extends from end 14 of cap 25 of the closure. Between the upper turn 11 of the cap 25 and the sealing shank 13 there is provided a sealing lip 15 which, when bottle 1 is closed, is seated upon the upper edge 16 of the neck 3 of the bottle.

Figure 4:
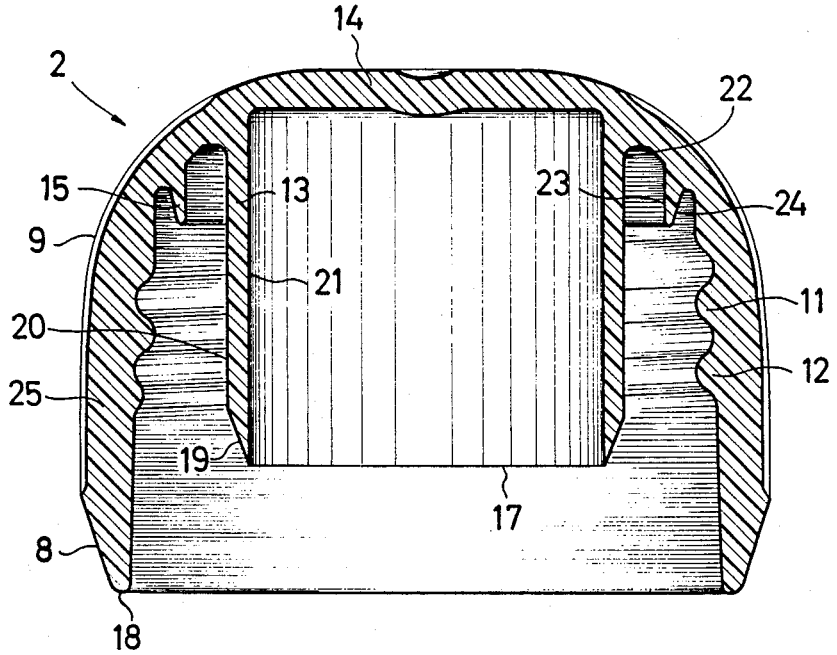
FIG. 4 is a greatly enlarged view of a bottle closure in cross-section.

FIG. 4 shows the bottle closure 2 in greatly enlarged scale and in cross-section. It is clearly visible that the bottle closure consists essentially of sealing shank 13 and cap 25. It can also be seen that lower edge 17 of sealing shank 13 is provided below the lowermost thread turn 12 but above the lower edge 18 of the cap 25.

In the lower part of the sealing shank 13 there is a chamfer 19 which facilitates the insertion of the sealing shank into the neck of the bottle. Outer surface 20 of sealing shank 13 is smooth and extends substantially parallel to the imaginary longitudinal axis of bottle closure 2. The inner surface 21 of the sealing shank 13 is also smooth and runs parallel to the outer surface 20.

When unscrewing the sealing shank 13 from the neck of the bottle, the lower part of the shank remains in the neck while the last turn 12 of the internal thread of cap 25 is no longer in engagement with the external thread of the neck 3 of the bottle. Under these circumstances, the $CO_2$ pressure in bottle 1 causes the bottle closure to be abruptly forced out, thus producing the "plop". The pressure of the sealing shank 13 against the inner wall of neck 3 of the bottle is sufficient to produce the "plop", especially since, in most bottles, the curvature 10 maintains an elevated pressure to the end.

We claim:

1. A bottle closure for a champagne type bottle having a bead surrounding a neck of the bottle and an external screw thread provided between said bead and an upper edge of the neck of the bottle comprising a unitary body made of plastic, said body comprising a cap of a substantially dome form having a stopper like sealing shank of a hollow cylindrical shape which penetrates into the neck of the bottle, said shank running substantially centrally from an inner end surface of said cap, said shank having a wall having a smooth outer surface, an internal thread provided on an internal surface of the wall of the cap which is engageable with the external thread of the neck of the bottle, said sealing shank projecting beyond an area carrying the internal thread, and an inner diameter of a lower edge of the cap well being larger than a diameter of said bead, and a sealing lip provided between an upper end of the sealing shank and a first turn of the internal thread on said inner end surface of said cap, said sealing lip bearing upon the upper edge of the champagne type bottle when the bottle closure is in place with said lower edge of the cap covering said bead when the bottle closure is in place whereby when said champagne type bottle is opened, a plop noise occurs.

2. A bottle closure according to claim 1, wherein the end of the sealing shank which penetrates into the neck of the bottle comprises a chamfer.

3. A bottle closure according to claim 1, wherein the sealing shank comprises an inner periphery which is parallel to the outer surface of the sealing shank and an outer periphery which is inclined thereto.

4. A bottle closure according to claim 1, wherein from said inner end surface to said lower edge, said cap is about one third larger than the sealing shank, to enable the latter to be arranged completely within the bottle closure.

5. A bottle closure according to claim 1, wherein the external thread comprises at least three grooves between said bead and the upper edge of the neck of the bottle.

6. A bottle closure according to claim 1, wherein the neck of the bottle comprises a bead inside the upper edge thereof.

7. A bottle closure according to claim 1, wherein between the inner end of the sealing shank and the sealing lip there is provided a space into which said sealing lip can be pressed when the closure is in place.

* * * * *